US012575708B2

(12) United States Patent
Hu et al.

(10) Patent No.: US 12,575,708 B2
(45) Date of Patent: Mar. 17, 2026

(54) DISHWASHER APPLIANCE AND METHOD FOR OPERATING A DISHWASHER APPLIANCE INCLUDING A CLEAN INDICATOR

(71) Applicant: Haier US Appliance Solutions, Inc., Wilmington, DE (US)

(72) Inventors: Haitian Hu, Louisville, KY (US); Adam Hofmann, Louisville, KY (US); Paul Newsom, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 51 days.

(21) Appl. No.: 18/519,242

(22) Filed: Nov. 27, 2023

(65) Prior Publication Data

US 2025/0169671 A1 May 29, 2025

(51) Int. Cl.
*A47L 15/00* (2006.01)
*A47L 15/42* (2006.01)

(52) U.S. Cl.
CPC ..... *A47L 15/0018* (2013.01); *A47L 15/4259* (2013.01); *A47L 15/4293* (2013.01); *A47L 2401/26* (2013.01); *A47L 2501/26* (2013.01)

(58) Field of Classification Search
None
See application file for complete search history.

(56) References Cited

U.S. PATENT DOCUMENTS

| | | | |
|---|---|---|---|
| 5,151,884 | A | 9/1992 | Griffith et al. |
| 5,839,458 | A | 11/1998 | Delcarson |
| 10,624,522 | B1 | 4/2020 | Chan |
| 10,959,597 | B2 | 3/2021 | Saunders |
| 11,452,791 | B2 | 9/2022 | Kessler et al. |

FOREIGN PATENT DOCUMENTS

DE 102018109332 A1 10/2019

*Primary Examiner* — Rita P Adhlakha
(74) *Attorney, Agent, or Firm* — Dority & Manning, P.A.

(57) ABSTRACT

A dishwasher appliance includes a tub; a door, a sensor, and an indicator. The dishwasher performs an operation including determining a completion of a washing cycle, turning on the indicator, accumulating a first value relating to a first characteristic and a second value relating to a second characteristic, comparing the first accumulated value against a first threshold value and the second accumulated value against a second threshold value, determining that at least one of the first or second accumulated value is greater than its respective threshold value, and implementing a responsive action after determining that the at least one of the first or second accumulated value is greater than its respective threshold value.

7 Claims, 3 Drawing Sheets

DISHWASHER APPLIANCE AND METHOD FOR OPERATING A DISHWASHER APPLIANCE INCLUDING A CLEAN INDICATOR

FIELD OF THE INVENTION

The present subject matter relates generally to dishwasher appliances, and more particularly to notifications presented to users of dishwasher appliances.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. After being applied or directed towards the rack assemblies and/or articles therein, the wash liquid generally flows by gravity to or towards a bottom of the wash chamber, such as to a sump positioned at the bottom of the wash chamber. Dishwashing appliances are also typically equipped with one or more pumps, such as a circulation pump or a drain pump, for directing or motivating wash liquid from the sump to, e.g., the spray assemblies or an area outside of the dishwashing appliance.

Recently, dishwasher appliances have incorporated certain indicators which provide a visual indication to a user after completion of the washing cycle that the washing articles are clean. Such indicators can include lights, displays, or the like. However, existing indicators and methods of operation have certain drawbacks. For one example, the indicators can be deactivated prematurely to the dishwasher being fully emptied of the clean articles, leading to dirty dishes being added to clean dishes and requiring additional operations to reclean the tainted articles.

Accordingly, a dishwasher appliance that obviates one or more of the above-mentioned drawbacks would be desirable. In particular, a dishwasher appliance with improved monitoring of door action would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher appliance is provided. The dishwasher appliance may include a tub defining a receiving chamber; a door movably coupled to the tub to provide selective access to the receiving chamber, the door being movable between a latched position and an unlatched position; a sensor configured to sense a closed position of the door; an indicator configured to provide a visual indication; and a controller operably connected with the sensor and the indicator, the controller configured to perform an operation. The operation may include determining a completion of a washing cycle, wherein determining the completion of the washing cycle includes turning on the indicator; accumulating each of a first value relating to a first characteristic and a second value relating to a second characteristic in response to determining the completion of the washing cycle, the first characteristic including a number of openings of the door from the latched position to the unlatched position and the second characteristic including a total time during which the door is in the unlatched position; comparing the first accumulated value against a first threshold value and the second accumulated value against a second threshold value; determining that at least one of the first or second accumulated value is greater than its respective threshold value; and implementing a responsive action after determining that the at least one of the first or second accumulated value is greater than its respective threshold value.

In another exemplary aspect of the present disclosure, a method of operating a dishwasher appliance is provided. The dishwasher appliance may include a tub, a door movably coupled to the tub between a latched position and an unlatched position, a sensor configured to sense a closed position of the door, and an indicator. The method may include determining a completion of a washing cycle, wherein determining the completion of the washing cycle includes turning on the indicator; accumulating each of a first value relating to a first characteristic and a second value relating to a second characteristic in response to determining the completion of the washing cycle, the first characteristic including a number of openings of the door from the latched position to the unlatched position and the second characteristic including a total time during which the door is in the unlatched position; comparing the first accumulated value against a first threshold value and the second accumulated value against a second threshold value; determining that at least one of the first or second accumulated value is greater than its respective threshold value; and implementing a responsive action after determining that the at least one of the first or second accumulated value is greater than its respective threshold value.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
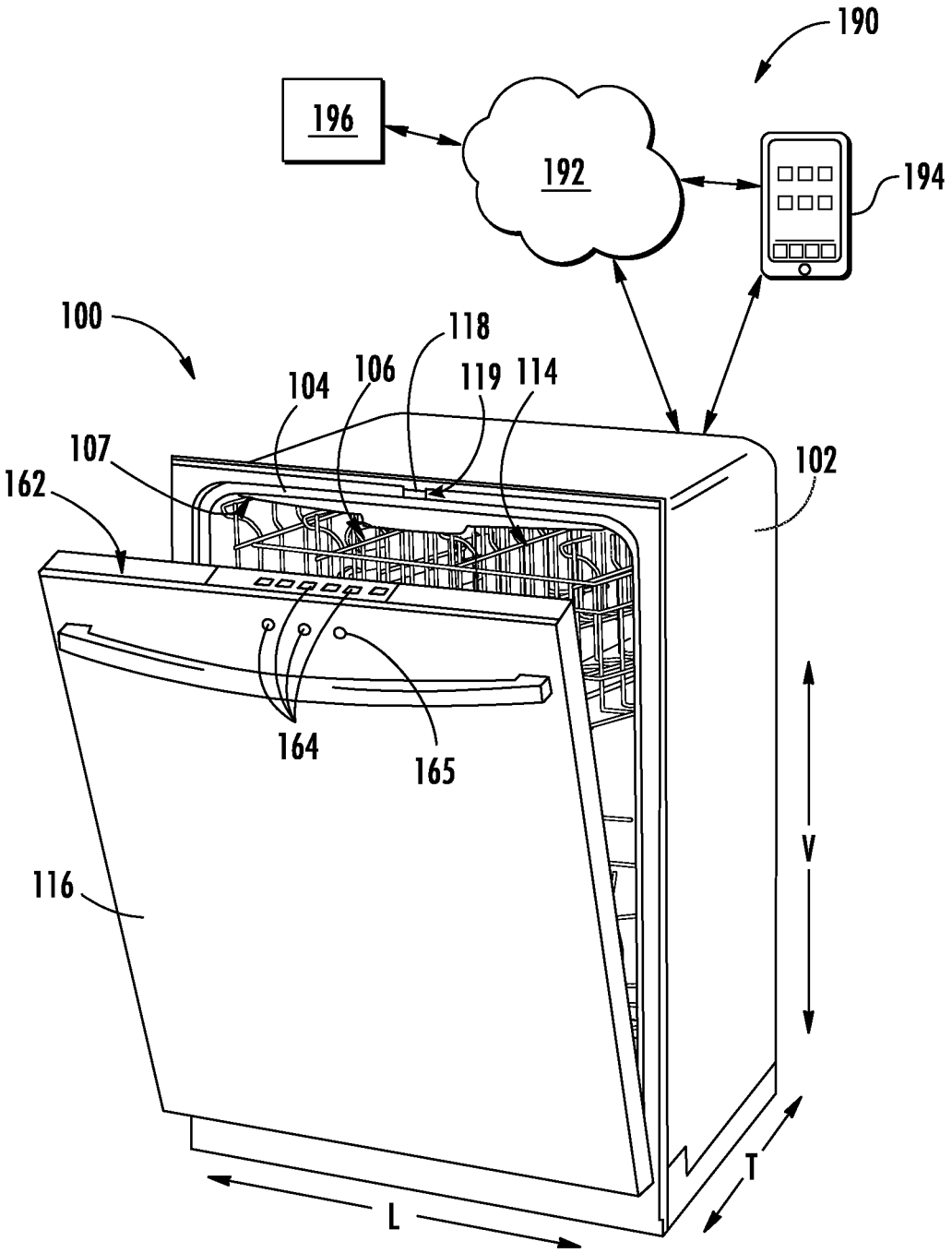
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
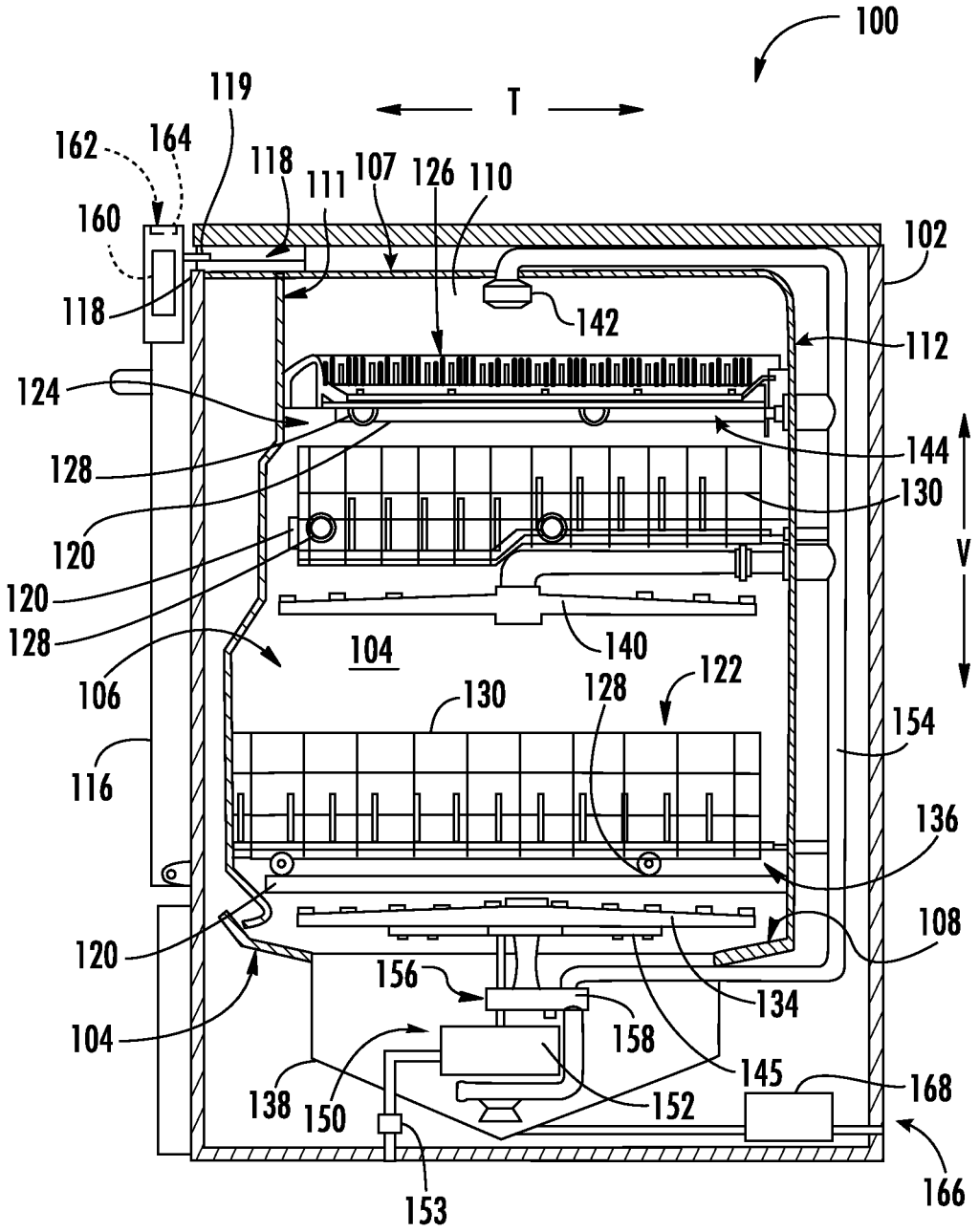
FIG. 2 provides a side, cross-sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 (FIG. 1). In some embodiments, the dishwasher appliance 100 may also include a door 116 at the front opening 114. The door 116 may, for example, be hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106. For instance, door closure mechanism 118 may be a latch or latch system. A latch arm, tab, or protrusion may be positioned on one of door 116 or tub 104 while a latch receptacle or cavity may be positioned on the other of door 116 or tub 104. Accordingly, door 116 may be selectively movable between an unlatched position (FIG. 1) and a latched position (FIG. 2).

Dishwasher 100 may include a sensor 119. Sensor 119 may be positioned at door closure mechanism 118. Accordingly, sensor 119 may be configured to monitor a position of door 116 (e.g., whether door 116 is in the latched or unlatched position). Sensor 119 may be operably connected with a controller (e.g., controller 160, described below). Sensor 119 may send signals to the controller to indicate the position of the door at certain intervals. Additionally or alternatively, sensor 119 may be configured to emit a signal to the controller any time door 116 is moved from the latched position to the unlatched position, or vice versa. Sensor 119 may be any suitable type of sensor, such as an electronic sensor, a mechanical sensor, an electromechanical sensor, an optical sensor, a magnetic sensor, or the like.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash liquid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106. In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash liquid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash liquid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash liquid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210 (e.g., FIG. 4). For instance, filter clean spray assembly 145 may be directed downward to urge a flow of wash liquid across a portion of filter assembly 210 (FIG. 4) or sump 138.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 may be positioned between the external water supply line and circulation pump 152 (e.g., to selectively allow water to flow from the external water supply line to circulation pump 152). Additionally or alternatively, water inlet valve 153 may be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash liquid throughout wash chamber 106.

In some embodiments, primary supply conduit 154 is used to supply wash liquid to one or more spray assemblies (e.g., to mid-level spray arm assembly 140 or upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, primary supply conduit 154 could be used to provide wash liquid to mid-level spray arm assembly 140 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray arm assembly 134 and 140, upper spray assembly 142, integral spray manifold 144, filter clean assembly 145, or other spray device may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, circulation pump 152 urges or pumps wash liquid (e.g., from filter assembly 210) to a diverter 156 (FIG. 2). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash liquid to the desired spray device.

In exemplary embodiments, diverter 156 is configured for selectively distributing the flow of wash liquid from circulation pump 152 to various fluid supply conduits—only some of which are illustrated in FIG. 2 for clarity. In certain embodiments, diverter 156 includes four outlet ports (not shown) for supplying wash liquid to a first conduit for rotating lower spray arm assembly 134, a second conduit for supplying wash liquid to filter clean assembly 145, a third conduit for spraying an auxiliary rack such as the silverware rack, and a fourth conduit for supply mid-level or upper spray assemblies 140, 142 (e.g., primary supply conduit 154).

Drainage of soiled wash liquid within sump 138 may occur, for instance, through a drain assembly 166 (e.g., during or as part of a drain cycle). In particular, wash liquid may exit sump 138 through a drain outlet and may flow through a drain conduit. In some embodiments, a drain pump 168 downstream of sump 138 facilitates drainage of the soiled wash liquid by urging or pumping the wash liquid to a drain line external to dishwasher 100. Drain pump 168 may be downstream of a filter (e.g., positioned at or near sump 138). Additionally or alternatively, an unfiltered flow path may be defined through sump 138 to drain conduit such that an unfiltered fluid flow may pass through sump 138 to drain conduit without first passing through filtration media.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses. For at least one example, user interface 164 includes an indicator 165. Indicator 165 may be a clean indicator to indicate that the load within tub 104 is in a clean state (e.g., after a completion of a washing cycle or operation). Indicator 165 may be a single light (e.g., light emitting diode or LED), a pattern of lights, a word, or the like.

Controller 160 may include a timer. For instance, one or more of the circuitry provided within controller 160 may be configured to perform a time keeping operation. For at least one example, as will be explained further below, controller 160 (via the timer) may keep track of a length of time for which door 116 is in the unlatched position. Additionally or alternatively, the timer may be provided as a separate instrument within dishwasher 100. Further still, the timer may be incorporated as part of a remote terminal (e.g., a consumer device, described below).

Referring back to FIG. 1, a schematic diagram of an external communication system 190 will be described according to an exemplary embodiment of the present subject matter. In general, external communication system 190 is configured for permitting interaction, data transfer, and other communications with dryer appliance 100. For example, this communication may be used to provide and receive operating parameters, cycle settings, performance characteristics, user preferences, user notifications, or any other suitable information for improved performance of dryer appliance 100. Additionally or alternatively, external communication system 190 may facilitate communication between dryer appliance 100 and one or more additional appliances, such as a washing machine appliance.

External communication system 190 permits controller 166 of dryer appliance 100 to communicate with external devices either directly or through a network 192. For example, a consumer may use a consumer device 194 to communicate directly with dryer appliance 100. For example, consumer devices 194 may be in direct or indirect communication with dryer appliance 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with dryer appliance 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g., TCP/IP, HTTP, SMTP, FTP), encodings or formats (e.g., HTML, XML), and/or protection schemes (e.g., VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, receive user notifications or instructions, etc. In addition, consumer device 194 and remote server 196 may communicate with dryer appliance 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

Now that the construction of a dishwasher appliance 100 and the configuration of controller 160 according to exemplary embodiments have been presented, an exemplary method 300 of operating a dishwasher appliance will be described. Although the discussion below refers to the exemplary method 300 of operating dishwasher appliance 100, one skilled in the art will appreciate that the exemplary method 300 may be applicable to the operation of a variety of other appliances, for instance, appliances including doors (e.g., washing machine appliances, refrigerator appliances, etc.). In exemplary embodiments, the various method steps as disclosed herein may be performed by controller 160 or a separate, dedicated controller.

Figure 3:
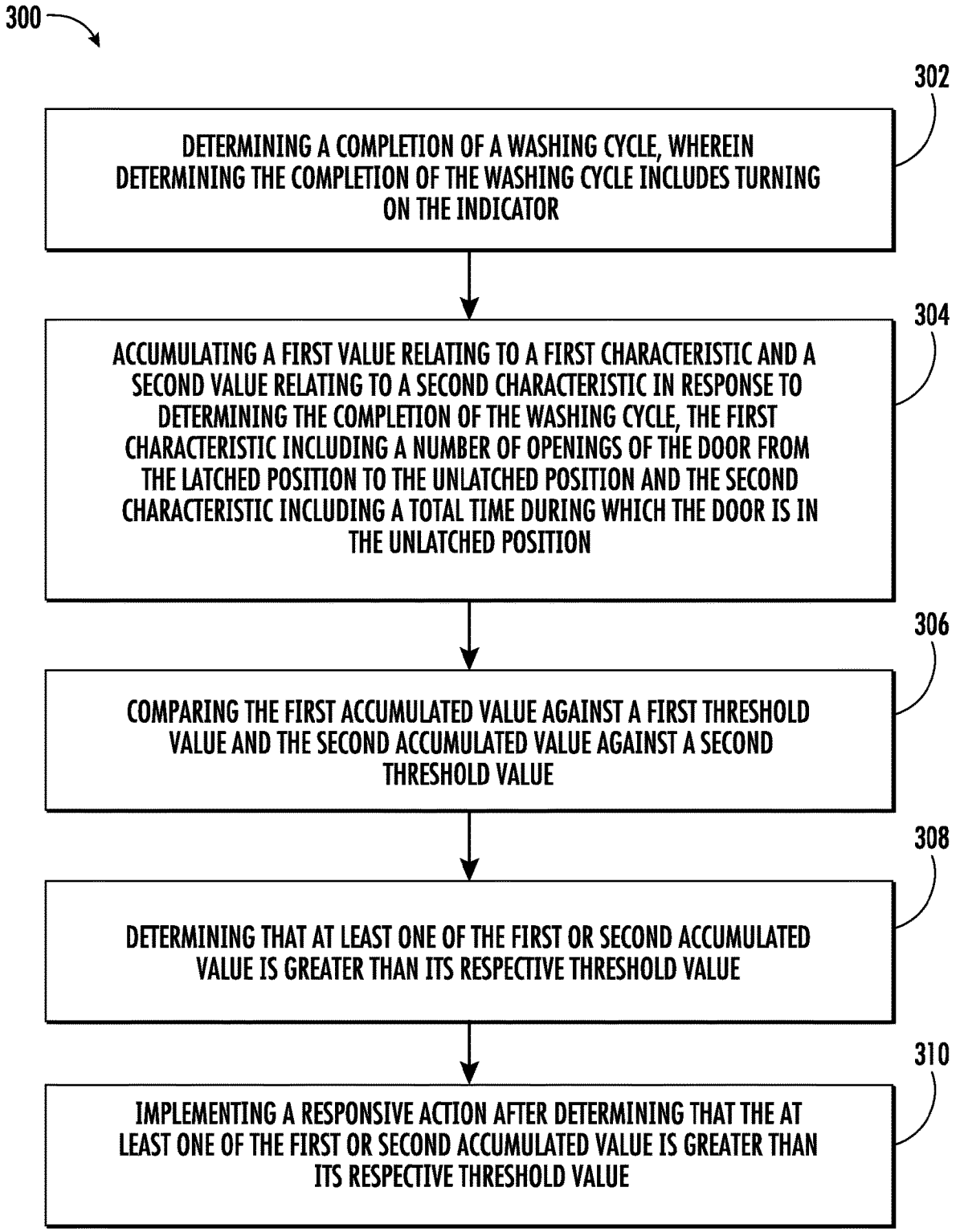
FIG. 3 provides a flow chart illustrating a method of operating a dishwasher appliance according to exemplary embodiments of the present disclosure.

Referring now to FIG. 3, at step 302, method 300 may include determining a completion of a washing cycle. For instance, method 300 may determine that a washing load (e.g., dishes) within the appliance is in a clean state. In determining that the washing cycle is complete, method 300 may turn on (e.g., activate, illuminate, provide power to, etc.) an indicator (e.g., indicator 165) on the appliance. As mentioned above, the indicator may be a "clean" indicator, indicating a clean status of the appliance. Accordingly, at the conclusion of the washing cycle or operation, the clean light indicator is turned on.

At step 304, method 300 may include accumulating a first value relating to a first characteristic and a second value relating to a second characteristic in response to determining the completion of the washing cycle. In detail, at the conclusion of the washing cycle, a plurality of characteristics (e.g., inputs, actions, etc.) may be monitored. The plurality of characteristics may include a first characteristic and a second characteristic. The first characteristic may be a number of openings of the door (e.g., from the latched position to the unlatched position). The second characteristic may be a total time during which the door is maintained in the unlatched position. However, it should be understood that additional or alternative characteristics may be incorporated for specific embodiments of the present disclosure.

Each of the plurality of characteristics may include be defined by a value. For example, the number of openings of the door may be measured in integers (e.g., one unlatch being one opening, two unlatches being two openings, etc.). Accordingly, method 300 may accumulate a total number of times the door is opened from the latched position to the unlatched position after the completion of the washing cycle. The accumulated first value of openings may be temporarily stored (e.g., on board the appliance or on a connected device).

For another example, the total time during which the door is maintained in the unlatched position may be measured in time increments (e.g., seconds, minutes, etc.). Thus, once the door is moved from the latched position to the unlatched position, a timer may be triggered to initiate a time keeping operation. For as long as the door is in the unlatched position, the timer may continue to accrue the time value. Once the door is moved (e.g., closed) back to the latched position, the timer may be paused. However, should the door be once again moved from the latched position to the unlatched position (e.g., opened), the timer may be restarted. The restart may continue from the pause point from the previous door latching. Accordingly, a total accrued or accumulated time for which the door is in the unlatched position may be determined (e.g., measured). Thus, the accumulated second value of unlatched time may be temporarily stored (e.g., on board the appliance or on a connected device).

At step 306, method 300 may include comparing the first accumulated value against a first threshold value and the second accumulated value against a second threshold value. For instance, the appliance (e.g., a controller of the appliance or connected with the appliance) may include a plurality of threshold values relating to the plurality of characteristics. The plurality of threshold values may include the first threshold value associated with the first value of the first characteristic and a second threshold value associated with the second value of the second characteristic. Each of the first and second threshold values may be predetermined. For instance, a baseline threshold number of openings of the door (e.g., the first characteristic) and a baseline threshold amount of time the door is in the unlatched position (e.g., the second characteristic) may be stored within the appliance.

The first accumulated value for the first characteristic (e.g., the number of door openings or unlatchings) may be compared against the first threshold value. For instance, the first threshold value may be between 3 and 5 openings. Accordingly, each time the door is moved from the latched position to the unlatched position, method 300 may compare the accumulated total against the threshold value.

Similarly, the second accumulated value for the second characteristic (e.g., the total length of time for which the door remains in the unlatched position) may be compared against the second threshold value. For instance, the second threshold value may be between about 3 minutes and about 5 minutes. However, the second threshold value may differ according to specific embodiments, particular appliances, individual operations, or the like. Further, as will be discussed below, each of the plurality of threshold values may be adjusted, fine-tuned, or otherwise changed (e.g., by a user). Accordingly, the accumulated length of time for which the door is in the unlatched position may be compared against the second threshold value.

At step 308, method 300 may include determining that at least one of the first or second accumulated value is greater than its respective threshold value. In detail, each of the first accumulated value and the second accumulated value may be simultaneously accrued and compared against its respective threshold value. Once one of the plurality of accumulated values surpasses its respective threshold value, method 300 may proceed. For one example, each time the door is moved from the latched position to the unlatched position, a count is added to the first value and the timer is activated to add to the second value. In some scenarios, the door is moved to the unlatched position a greater number of times than the first threshold value before the accumulated time of being in the unlatched position reaches the second threshold value. In alternative scenarios, the door is moved to the unlatched position a single time where it may remain for an extended period of time, elapsing the second threshold value without accruing additional unlatchings. Thus, only one of the plurality of characteristics may surpass its respective threshold to trigger an advancement of method 300.

According to at least some embodiments, method 300 may include providing a notification to a user relating to each of the plurality of threshold values. For instance, after determining that the at least one of the first or second accumulated value is greater than its respective threshold value, method 300 may present a notification to the user (e.g., via network connection 190). The notification may include a prompt to provide feedback relating to the operation. For instance, the notification may present the user with an opportunity to provide inputs relating to the recently completed washing cycle (e.g., regarding one or more of the plurality of threshold values).

For one example, a user can increase the second threshold value for which the door remains in the opened and unlatched state. Thus, for users who prefer to air dry a dishwasher load with the door open, the second threshold value can be increased to account for an extended opening period during the drying. For another example, a user can increase the first threshold value for the number of times the door is moved to the unlatched position. Thus, for users who temporarily open the door to retrieve a single item for use multiple times, the first threshold value can be increased to account for a greater number of door openings.

Method 300 may then include adjusting at least one of the first or second threshold values in response to receiving the inputs. In some instances, the appliance (e.g., via the controller) may analyze the received inputs together with the currently implemented threshold values. One or more adjustments may then be made to the stored threshold values. Advantageously, individualized and tailored threshold values may be determined for unique users.

At step 310, method 300 may include implementing a responsive action after determining that the at least one of the first or second accumulated value is greater than its respective threshold value. In detail, implementing the responsive action may include turning off (e.g., deactivating, depowering, unilluminating, etc.) the indicator. As mentioned above, the indicator may be a "clean" indicator. Accordingly, throughout the accumulation of the first value of the first characteristic and the second value of the second characteristic, the indicator will have remained in the activated, lit, illuminated, or powered state. Once at least one of the threshold values is reached, method 300 may determine that there is no longer a clean washing load present within the appliance.

For one example, once the door is unlatched the first threshold value number of times, method 300 determines that the dishwasher has been properly and fully emptied. For another example, once the door has been maintained in the unlatched state for the second threshold value length of time, method 300 determined that the dishwasher has been properly and fully emptied. Accordingly, the indicator indicating the clean state of the appliance may be turned off to signal to users that the dishwasher is in a state to accept dirty dishware.

Method 300 may include resetting each of the first accumulated value and the second accumulated value in response to determining that the at least one of the first or second accumulated value is greater than its respective threshold value. For one example, when the first accumulated value surpasses the first threshold value, each of the first accumulated value and the second accumulated value are reset, regardless of whether the second accumulated value has reached the second threshold value. Accordingly, method 300 may be reset to initiate from zero values upon the completion of a subsequent washing operation or cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub defining a receiving chamber;

a door movably coupled to the tub to provide selective access to the receiving chamber, the door being movable between a latched position and an unlatched position;

a sensor configured to sense a closed position of the door;

an indicator configured to provide a visual indication wherein the indicator is a light to indicate a clean status of the dishwasher appliance; and a controller operably connected with the sensor and the indicator, the controller configured to perform an operation, the operation comprising:

determining a completion of a washing cycle, wherein determining the completion of the washing cycle comprises turning on the indicator;

accumulating each of a first value relating to a first characteristic and a second value relating to a second characteristic in response to determining the completion of the washing cycle, the first characteristic comprising a number of openings of the door from the latched position to the unlatched position and the second characteristic comprising a total time during which the door is in the unlatched position;

comparing the first accumulated value against a first threshold value and the second accumulated value against a second threshold value;

determining that at least one of the first or second accumulated value is greater than its respective threshold value; and after determining that the at least one of the first or second accumulated value is greater than its respective threshold value, implementing a responsive action after determining that the at least one of the first or second accumulated value is greater than its respective threshold value and the dishwasher door has transitioned from the unlatched position to the latched position, wherein the responsive action comprises automatically deactivating the indicator to indicate that the dishwasher appliance is ready to receive soiled articles.

2. The dishwasher appliance of claim 1, wherein accumulating the first value relating to the first characteristic comprises:

determining, via the sensor, a number of times the door is moved from the latched position to the unlatched position.

3. The dishwasher appliance of claim 2, wherein the first threshold value comprises a threshold number of times the door is moved from the latched position to the unlatched position, the threshold number of times being a predetermined number.

4. The dishwasher appliance of claim 1, wherein accumulating the second value relating to the second characteristic comprises:

determining, via an on board timer, a length of time for which the door is maintained in the unlatched position.

5. The dishwasher appliance of claim 4, wherein the second threshold value comprises a threshold length of time for which the door is maintained in the unlatched position, the threshold length of time being a predetermined length of time.

6. The dishwasher appliance of claim 1, wherein the operation further comprises:

receiving one or more inputs from a user regarding the first threshold value for the first characteristic or the second threshold value for the second characteristic; and adjusting at least one of the first or second threshold value in response to receiving the one or more inputs from the user.

7. The dishwasher appliance of claim 1, wherein the operation further comprises:

resetting each of the first accumulated value and the second accumulated value in response to determining that the at least one of the first or second accumulated value is greater than its respective threshold value.

* * * * *